US010328710B2

(12) United States Patent
Shimomura et al.

(10) Patent No.: US 10,328,710 B2
(45) Date of Patent: Jun. 25, 2019

(54) RECORDING APPARATUS

(71) Applicant: SEIKO EPSON CORPORATION, Tokyo (JP)

(72) Inventors: Masaki Shimomura, Matsumoto (JP); Yoshihiro Otagiri, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/977,542

(22) Filed: May 11, 2018

(65) Prior Publication Data

US 2018/0326737 A1 Nov. 15, 2018

(30) Foreign Application Priority Data

May 15, 2017 (JP) ..... 2017-096231

(51) Int. Cl.

| | |
|---|---|
| ***B41J 2/175*** | (2006.01) |
| ***B41J 29/02*** | (2006.01) |
| ***B41J 29/13*** | (2006.01) |
| ***B41J 19/00*** | (2006.01) |

(52) U.S. Cl.

CPC ..... *B41J 2/17566* (2013.01); *B41J 2/1752* (2013.01); *B41J 2/17503* (2013.01); *B41J 2/17509* (2013.01); *B41J 19/005* (2013.01); *B41J 29/02* (2013.01); *B41J 29/13* (2013.01); *B41J 2/17523* (2013.01)

(58) Field of Classification Search

CPC ..... B41J 2/17523; B41J 2/17506; B41J 2/17553; B41J 2/17503; B41J 2/1752; B41J 2/17566; B41J 2/17509; B41J 2/165; B41J 19/005; B41J 29/02; B41J 29/13

See application file for complete search history.

(56) References Cited

U.S. PATENT DOCUMENTS 7,618,134 B2 * 11/2009 Kuriki ..... B41J 2/14201 347/37
9,315,031 B2 * 4/2016 Takeuchi ..... B41J 2/17523

FOREIGN PATENT DOCUMENTS

| | | | |
|---|---|---|---|
| JP | 07-060954 | A | 3/1995 |
| JP | 10-086357 | A | 4/1998 |
| JP | 2004-058633 | A | 2/2004 |
| JP | 2014-076612 | A | 5/2014 |
| JP | 2014-076613 | A | 5/2014 |

* cited by examiner

*Primary Examiner* — Thinh H Nguyen
(74) *Attorney, Agent, or Firm* — Workman Nydegger

(57) ABSTRACT

A recording apparatus includes a recording head, an ink supply section, a carriage, and a detection unit. The ink supply section supplies ink to the recording head. The carriage reciprocates in predetermined directions and is provided with the recording head and includes a passage junction to be connected to or disconnected from an ink passage formed between the ink supply section and the recording head. The detection unit converts a result of detecting a detection target into an electrical signal. One of the detection target and the detection unit is mounted in the carriage. The carriage has an ink guiding mechanism that guides the ink from a region positioned below the passage junction in a vertical direction to the detection target or an installation part for the detection unit.

10 Claims, 17 Drawing Sheets

RECORDING APPARATUS

INCORPORATED BY REFERENCE

The entire disclosure of Japanese Patent Application No. 2017-096231, filed May 15, 2017, is expressly incorporated by reference herein.

BACKGROUND

1. Technical Field

The present disclosure relates to a recording apparatus that records information on a medium, especially by ejecting ink onto the medium.

2. Related Art

Ink leakage has been a concern with recording apparatuses such as ink jet printers. When an ink jet printer records information on a medium by ejecting ink onto the medium, some of the ink may adhere to its internal part other than the medium, in which case the ink jet printer is vulnerable to a risk of various troubles. For example, if ink adheres to a wire inside an ink jet printer, this ink may be transferred to an end of the wire due to a capillary phenomenon, causing an electrical short-circuit. As a result, the ink jet printer can no longer conduct appropriate communication.

In some instances, ink leaks from a passage between an ink cartridge and a recording head. JP-A-2004-58633 discloses an ink jet recording apparatus in which a pair of electrodes that detects ink leakage is provided in the recording head. When the potential difference between electrodes exceeds a preset threshold, the ink jet recording apparatus displays a predetermined warning.

SUMMARY

The above ink jet recording apparatus requires a dedicated sensor to detect ink leakage and thus may involve cost increase.

An advantage of some aspects of the disclosure is that a low-cost recording apparatus can detect ink leakage.

A recording apparatus according to an aspect of the disclosure includes: a recording head from which ink is ejected; an ink supply section that supplies the ink to the recording head; a carriage that reciprocates in predetermined directions and that is provided with the recording head and includes a passage junction to be connected to or disconnected from an ink passage formed between the ink supply section and the recording head; and a detection unit that converts a result of detecting a detection target into an electrical signal, the detection unit being used to control at least one of the recording head and the carriage. One of the detection target and the detection unit is mounted in the carriage. The carriage has an ink guiding mechanism that guides the ink from a region positioned below the passage junction in a vertical direction to the detection target or an installation part for the detection unit.

According to the above aspect, the detection target to be detected by the detection unit or the detection unit used to control at least one of the recording head and the carriage is provided in the carriage. The carriage has an ink guiding mechanism that guides the ink from a region positioned below the passage junction in a vertical direction to the detection target or an installation part for the detection unit. If the passage junction leaks ink, this ink is guided to the installation part by the ink guiding mechanism. In response, a detection state of the detection unit changes so that the detection result is, in most cases, different from that obtained when the detection unit detects the detection target. On the basis of this detection state, the recording apparatus determines that the passage junction leaks ink.

In the above way, the recording apparatus can use existing components to detect leakage of ink from the passage junction without having to provide any dedicated sensor. In short, it is possible to provide a low-cost recording apparatus that can detect ink leakage.

The installation part is preferably mounted on an outer bottom of the carriage. The ink guiding mechanism preferably includes an ink exhaust port provided in a bottom of the carriage, the ink exhaust port allowing leaking ink to flow out from an inside to an outside of the carriage.

In the above configuration, the ink exhaust port provided in the bottom of the carriage allows leaking ink to flow out from the inside to the outside of the carriage, thereby guiding the ink to the installation part provided on the outer bottom of the carriage.

The ink guiding mechanism preferably includes an ink guiding path provided on an inner bottom of the carriage, and the ink is preferably guided from a region positioned below the passage junction in the vertical direction to the ink exhaust port along the ink guiding path.

In the above configuration, the ink is guided from the region positioned below the passage junction in the vertical direction to the ink exhaust port along the ink guiding path provided on the inner bottom of the carriage. Thus, this configuration can reliably guide the ink to the installation part by way of the ink exhaust port.

The ink exhaust port is preferably provided within a region positioned below the passage junction in the vertical direction. The ink guiding mechanism preferably includes an ink guiding path provided on the outer bottom of the carriage, the ink being guided from the ink exhaust port to the installation part along the ink guiding path.

In the above configuration, the ink exhaust port is provided within a region positioned below the passage junction in the vertical direction. The ink guiding mechanism includes an ink guiding path provided on the outer bottom of the carriage, and the ink is guided from the ink exhaust port to the installation part along the ink guiding path. Providing the ink guiding path in this manner can reliably guide the ink to the installation part.

The ink guiding path is preferably a rib. By forming the ink guiding path with the rib, the ink guiding path can be formed easily at low cost.

The ink guiding path is preferably a groove. By forming the ink guiding path with the groove, the ink guiding path can be formed easily at low cost.

The ink guiding path preferably includes a corner section formed in the carriage, the corner section having two surfaces that intersect each other.

By forming the ink guiding path with the corner section in the carriage which has two intersecting surfaces, the ink guiding path can be formed easily at low cost.

The outer bottom of the carriage is preferably provided with a cover that covers the installation part. The cover is preferably positioned between the detection target and the detection unit. The cover preferably guides the ink that has been guided to the installation part to a location at which the detection target and the detection unit are aligned with each other.

In the above configuration, the outer bottom of the carriage is provided with a cover that covers the installation part. The cover is positioned between the detection target and the detection unit. The cover guides the ink that has been guided to the installation part to a location at which the detection target and the detection unit are aligned with each other. Therefore, this configuration suppresses the detection target or the detection unit from being contaminated directly by ink. By replacing the cover with a new one, thus, a contaminated condition of the recording apparatus can be returned to be a normal clean condition. Consequently, this configuration can be maintained more easily than a configuration in which the detection target or the detection unit may be contaminated by ink.

The detection unit is preferably provided in the carriage, and preferably sets the detection target to a medium and detects an edge of the medium.

In the above configuration, the detection unit is provided in the carriage, and sets the detection target to a medium and detects an edge of the medium. This configuration can produce the effect of any of the foregoing configurations.

The detection unit is preferably provided in the carriage, and preferably sets the detection target to a linear scale meter and reads the linear scale meter.

In the above configuration, the detection unit is provided in the carriage, and sets the detection target to a linear scale meter and reads the linear scale meter. This configuration can produce the effect of any of the foregoing configurations.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Some embodiments of the disclosure will be described below with reference to the accompanying drawings. It should be noted that substantially the same components described in embodiments are denoted by identical characters, and will be described only once in the first embodiment and thus will not be described again in other embodiments.

Figure 1:
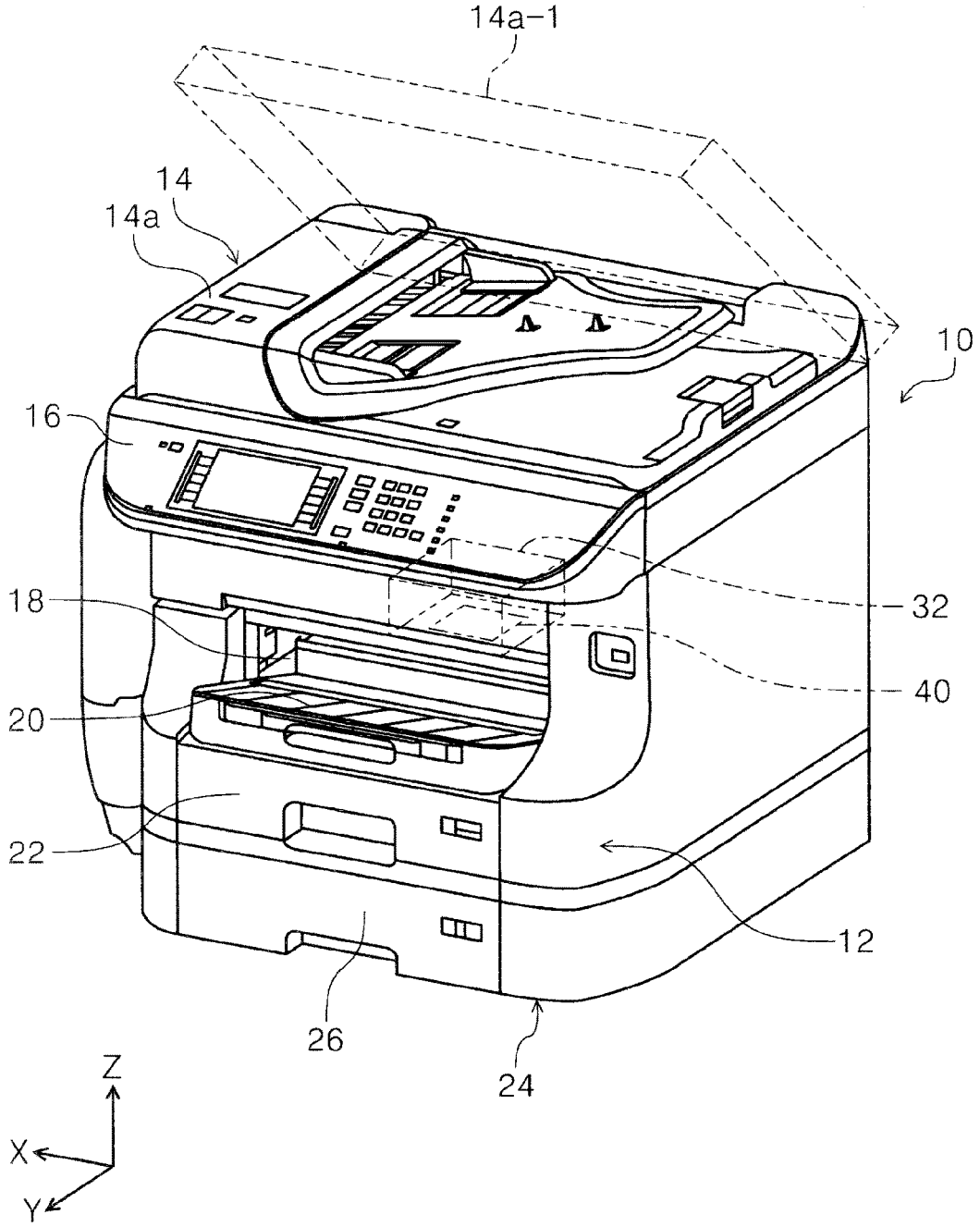
FIG. 1 is a perspective view of a printer according to a first embodiment of the disclosure.
Figure 2:
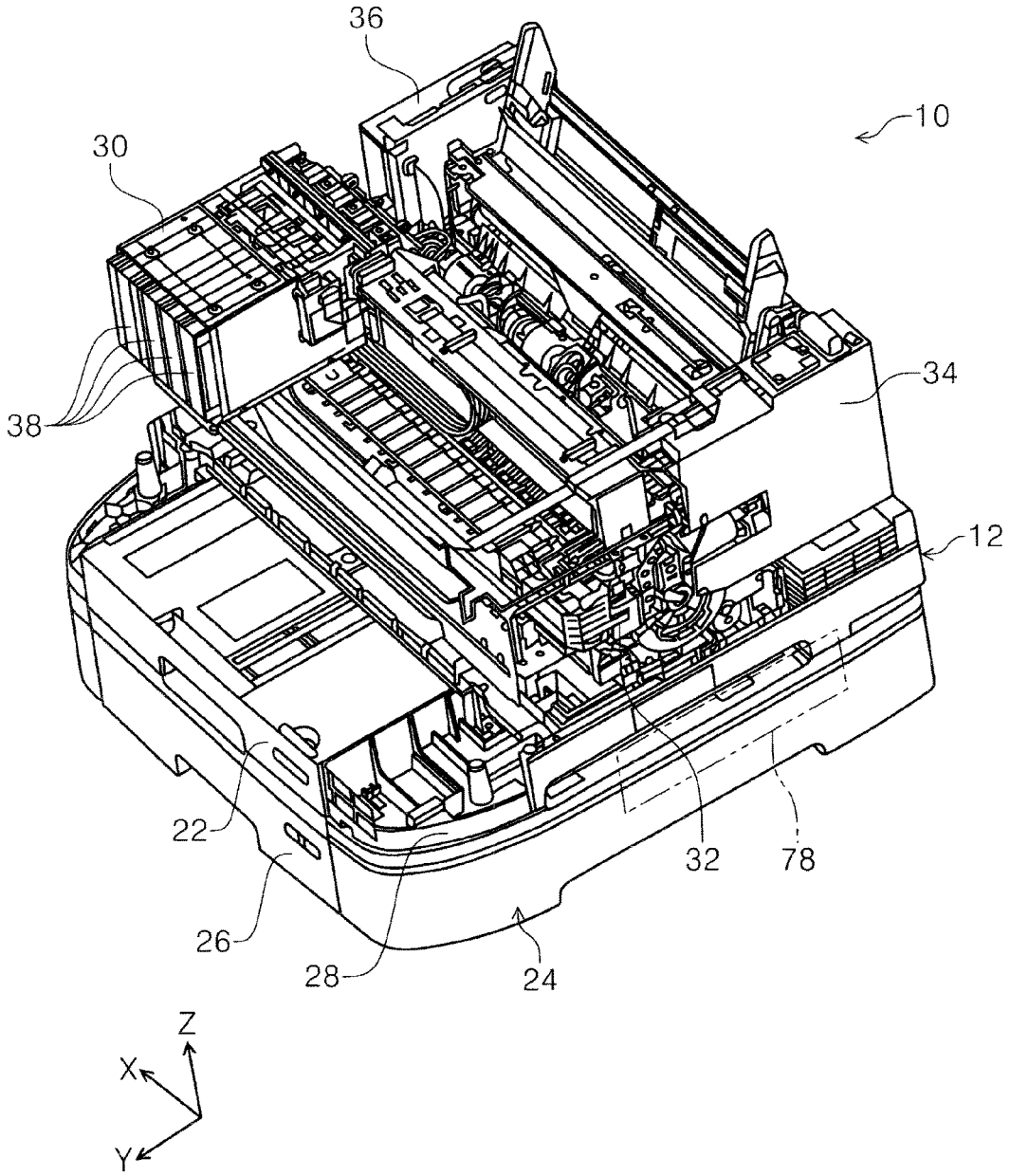
FIG. 2 is a perspective view of the apparatus main body of the printer according to a first embodiment of the disclosure.
Figure 3:
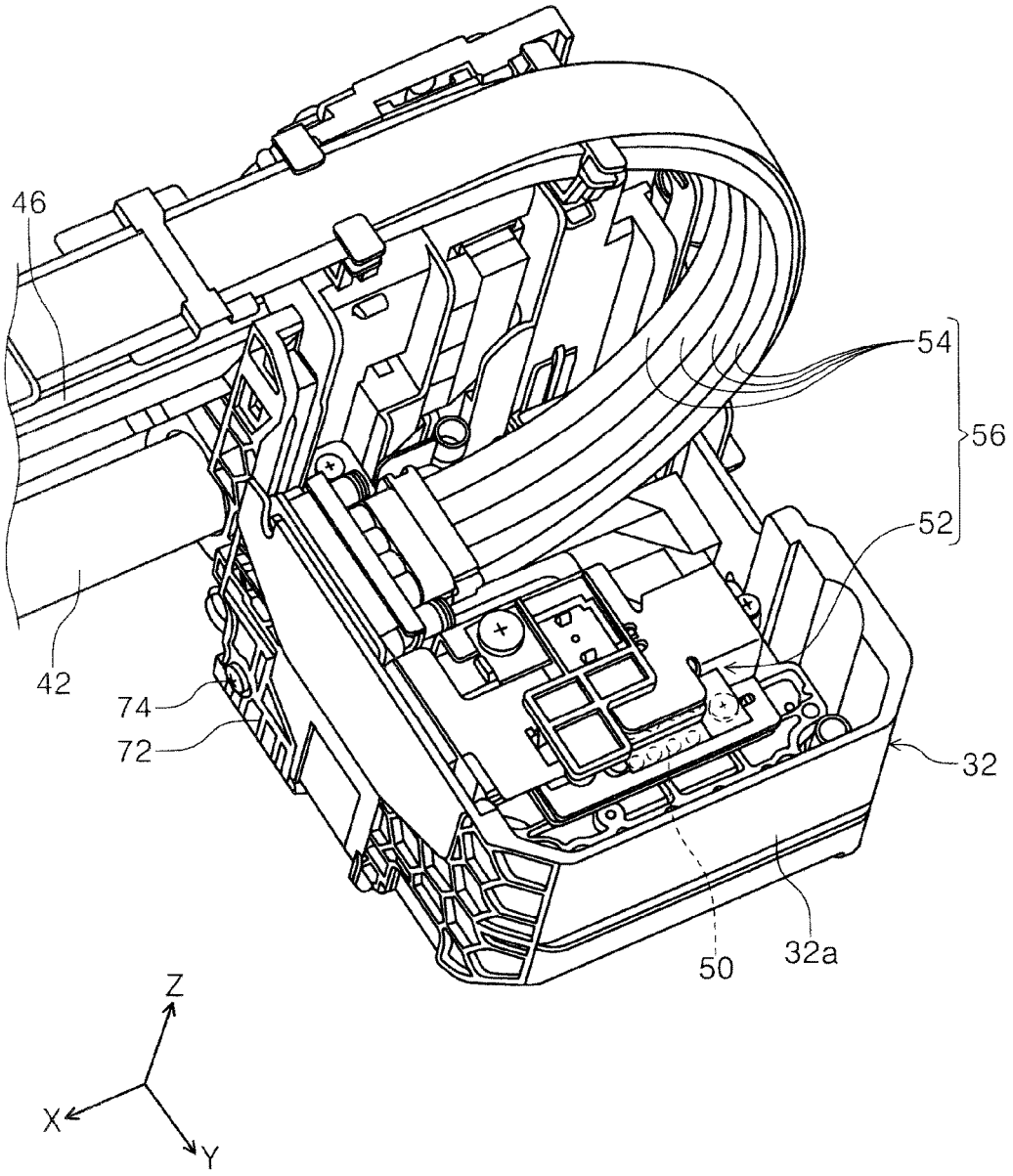
FIG. 3 is a perspective view of the carriage to which ink tubes are connected.
Figure 4:
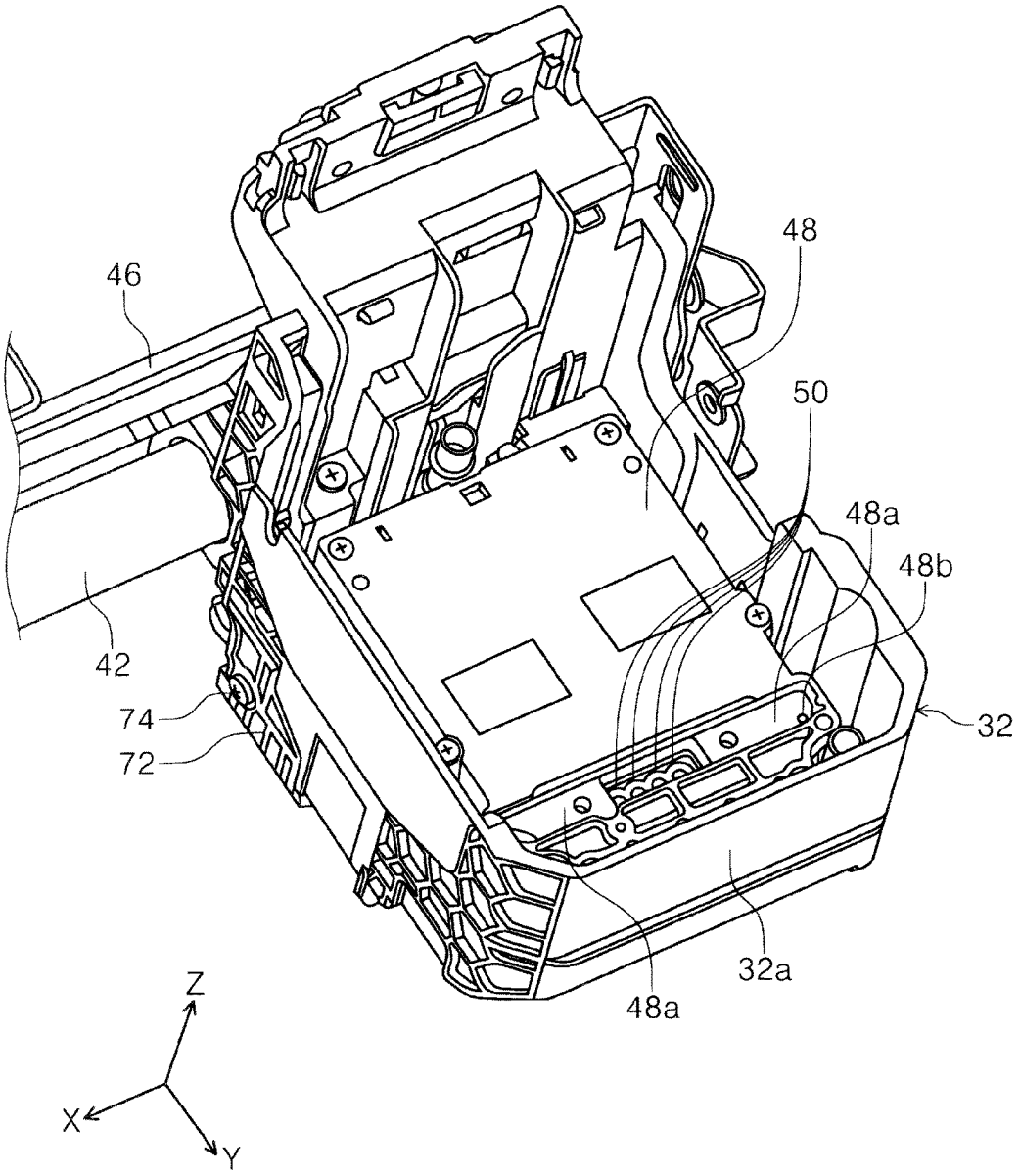
FIG. 4 is a perspective view of the carriage from which the ink tubes are disconnected.
Figure 5:
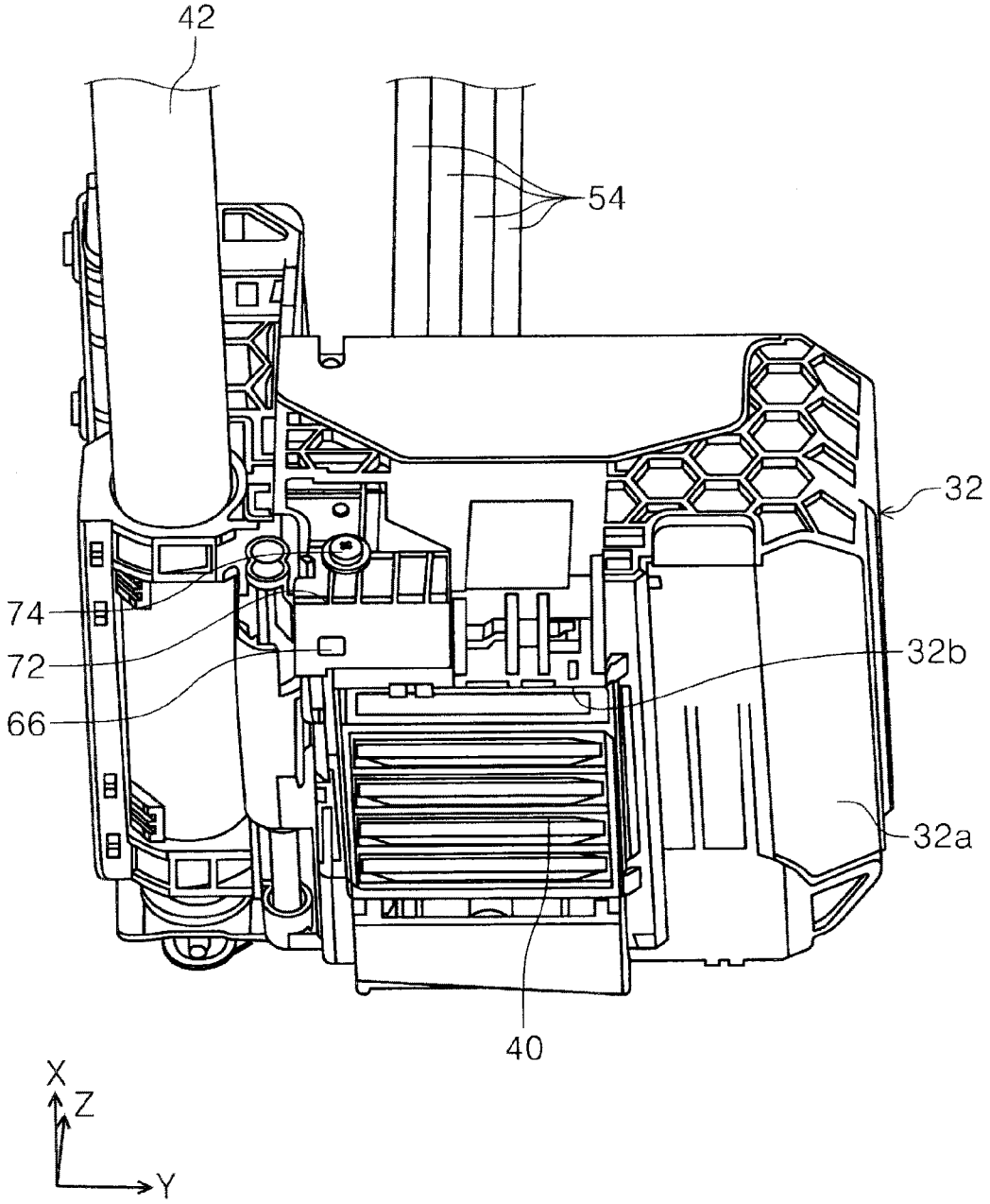
FIG. 5 is a perspective view of the bottom of the carriage.

FIG. 1 is a perspective view of a printer according to a first embodiment of the disclosure. FIG. 2 is a perspective view of the apparatus main body of the printer. FIG. 3 is a perspective view of the carriage to which ink tubes are connected. FIG. 4 is a perspective view of the carriage from which the ink tubes are disconnected. FIG. 5 is a perspective view of the bottom of the carriage.

Figure 6:
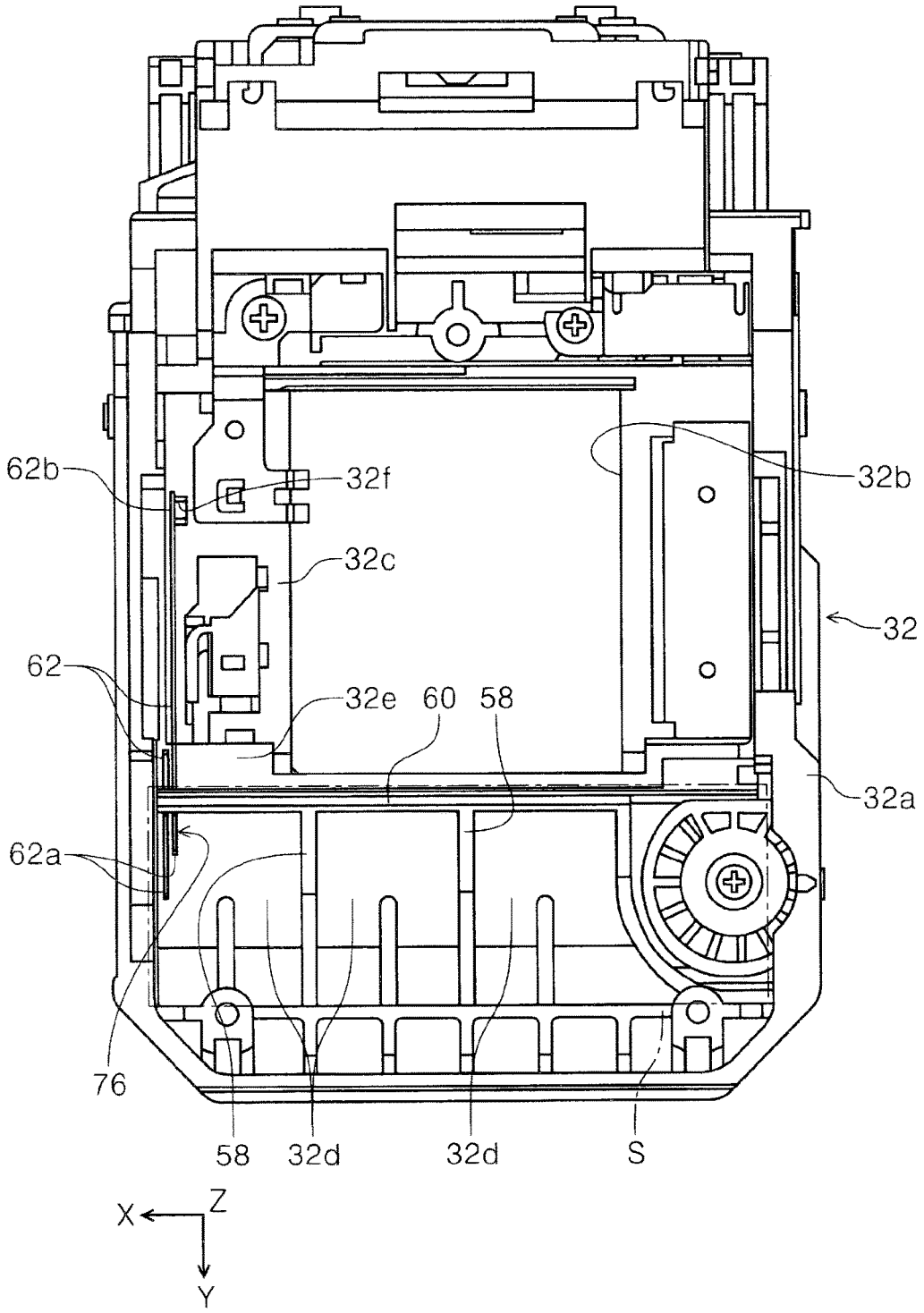
FIG. 6 is a plan view of the housing of the carriage.
Figure 7:
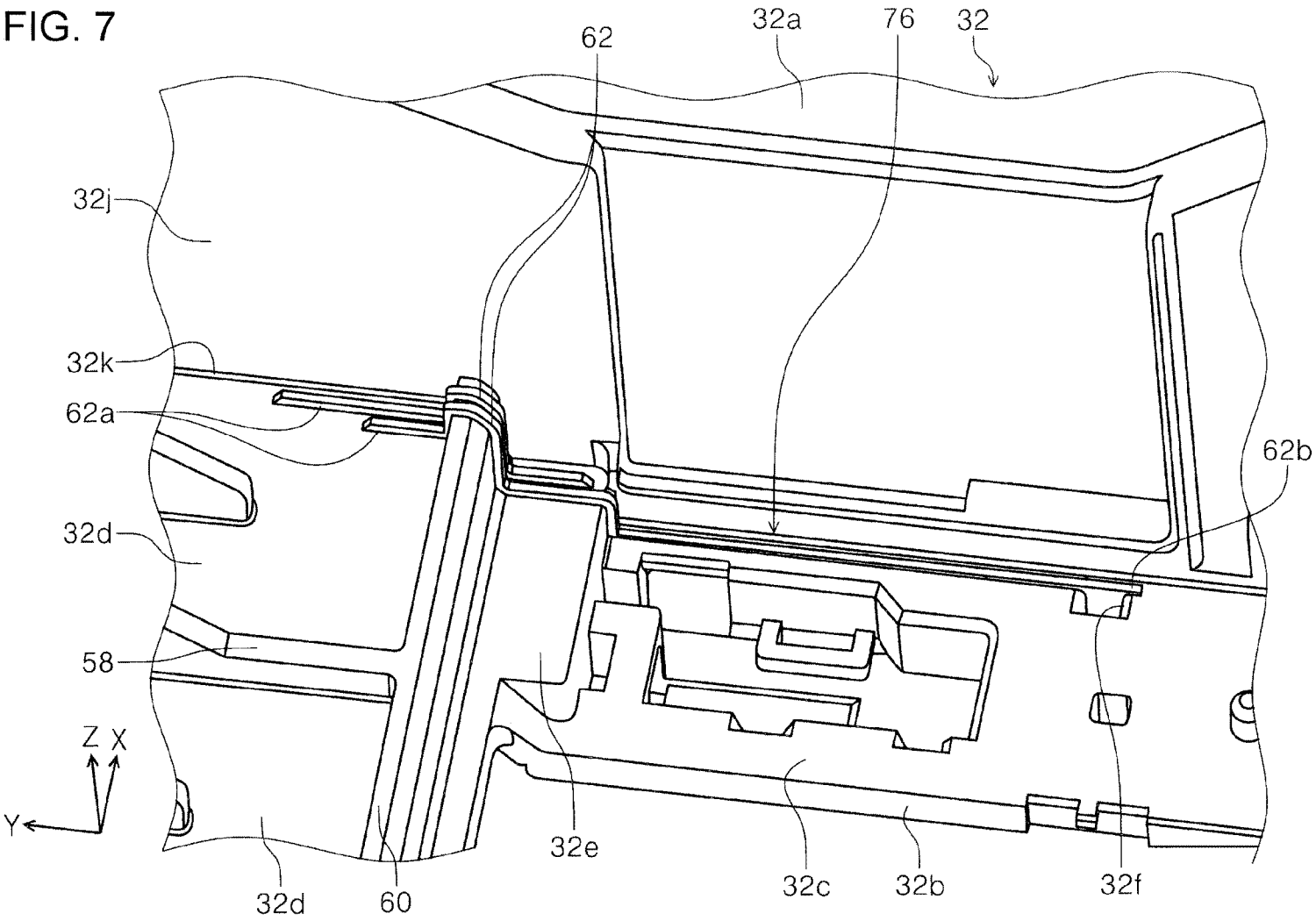
FIG. 7 is a perspective view of an ink guiding mechanism in the printer.
Figure 8:
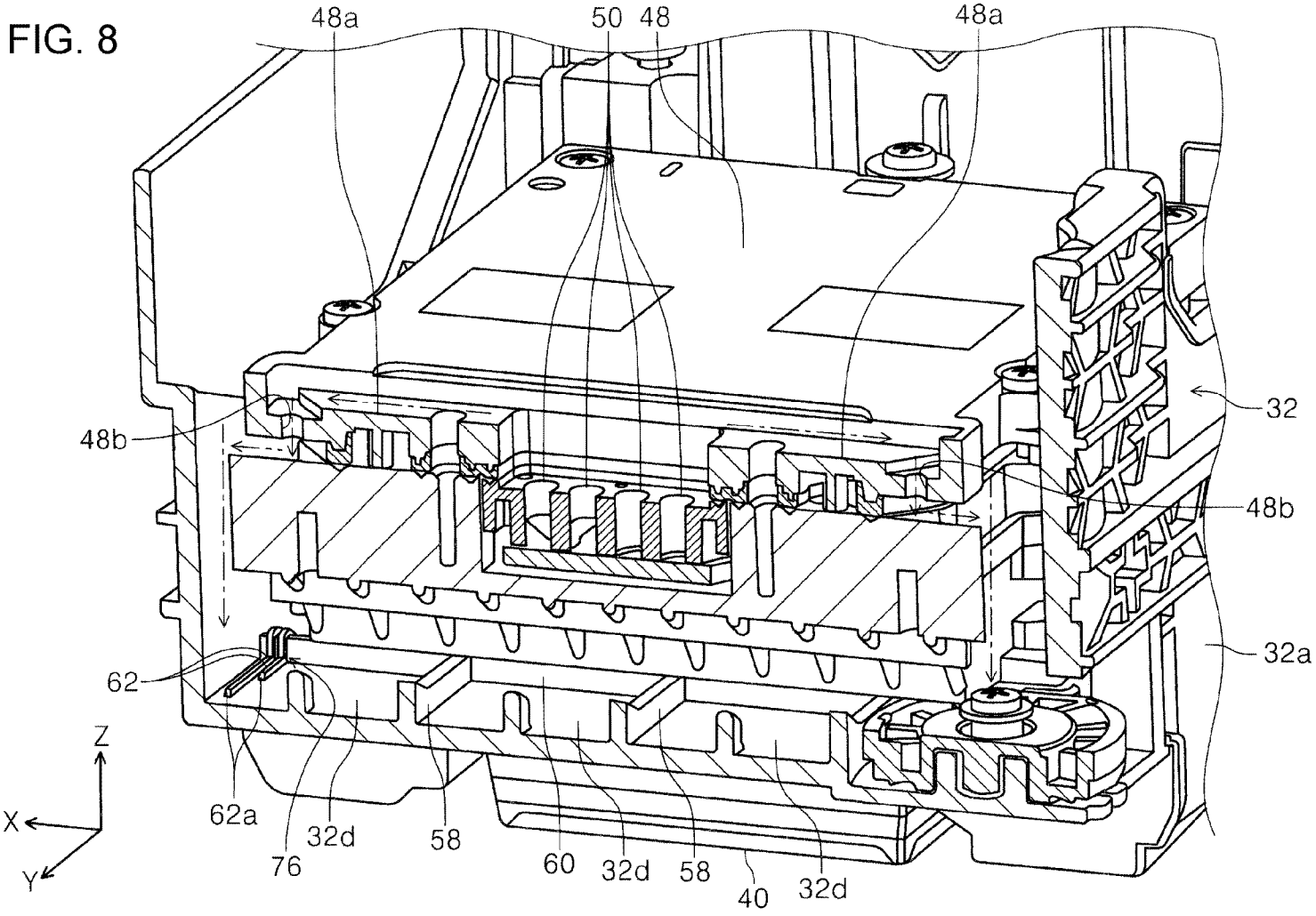
FIG. 8 is a cross-sectional view of a passage junction of the carriage.
Figure 9:
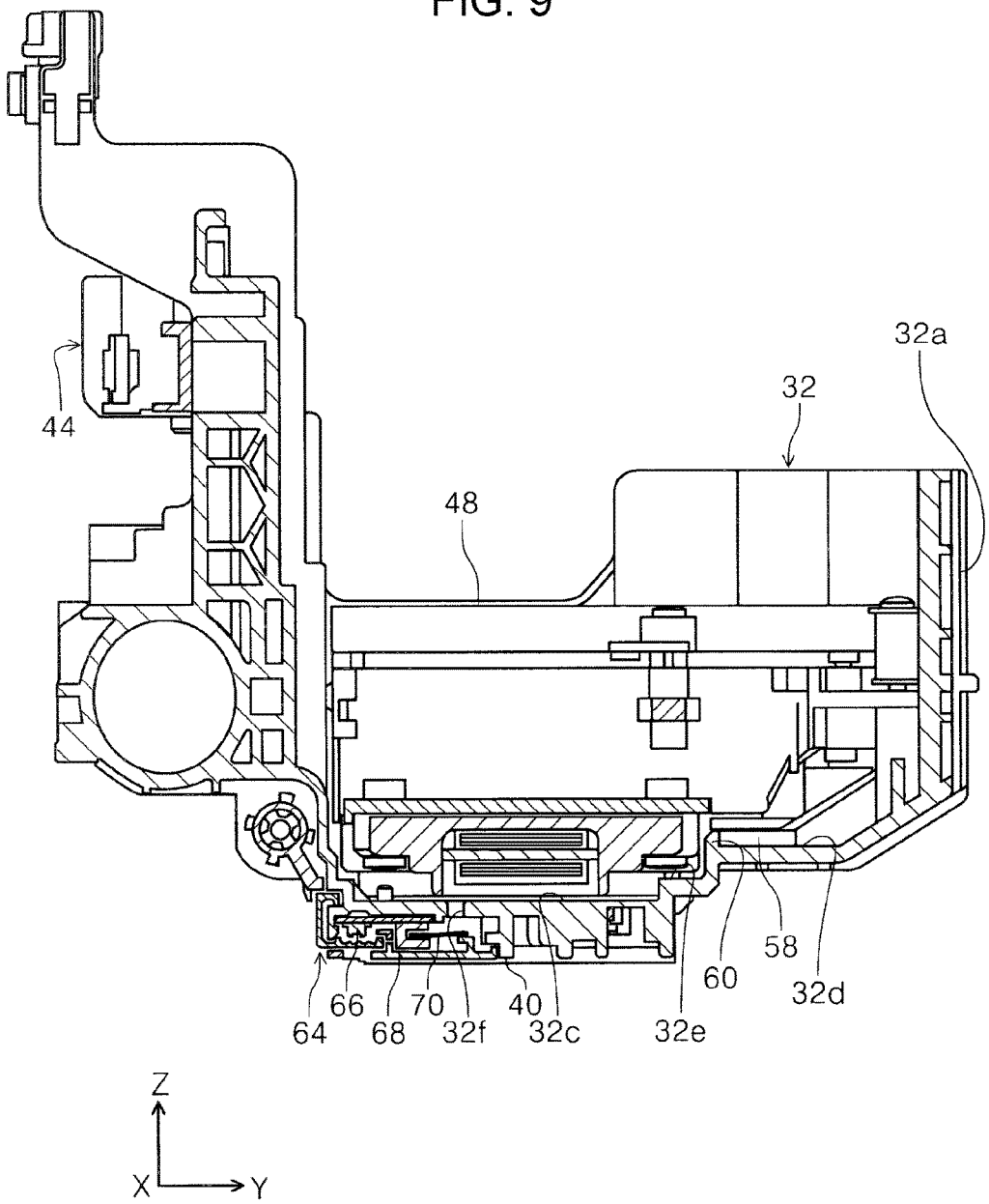
FIG. 9 is a side cross-sectional view of the carriage.

FIG. 6 is a plan view of the housing of the carriage. FIG. 7 is a perspective view of an ink guiding mechanism in the printer. FIG. 8 is a cross-sectional view of a passage junction of the carriage. FIG. 9 is a side cross-sectional view of the carriage.

Figure 10:
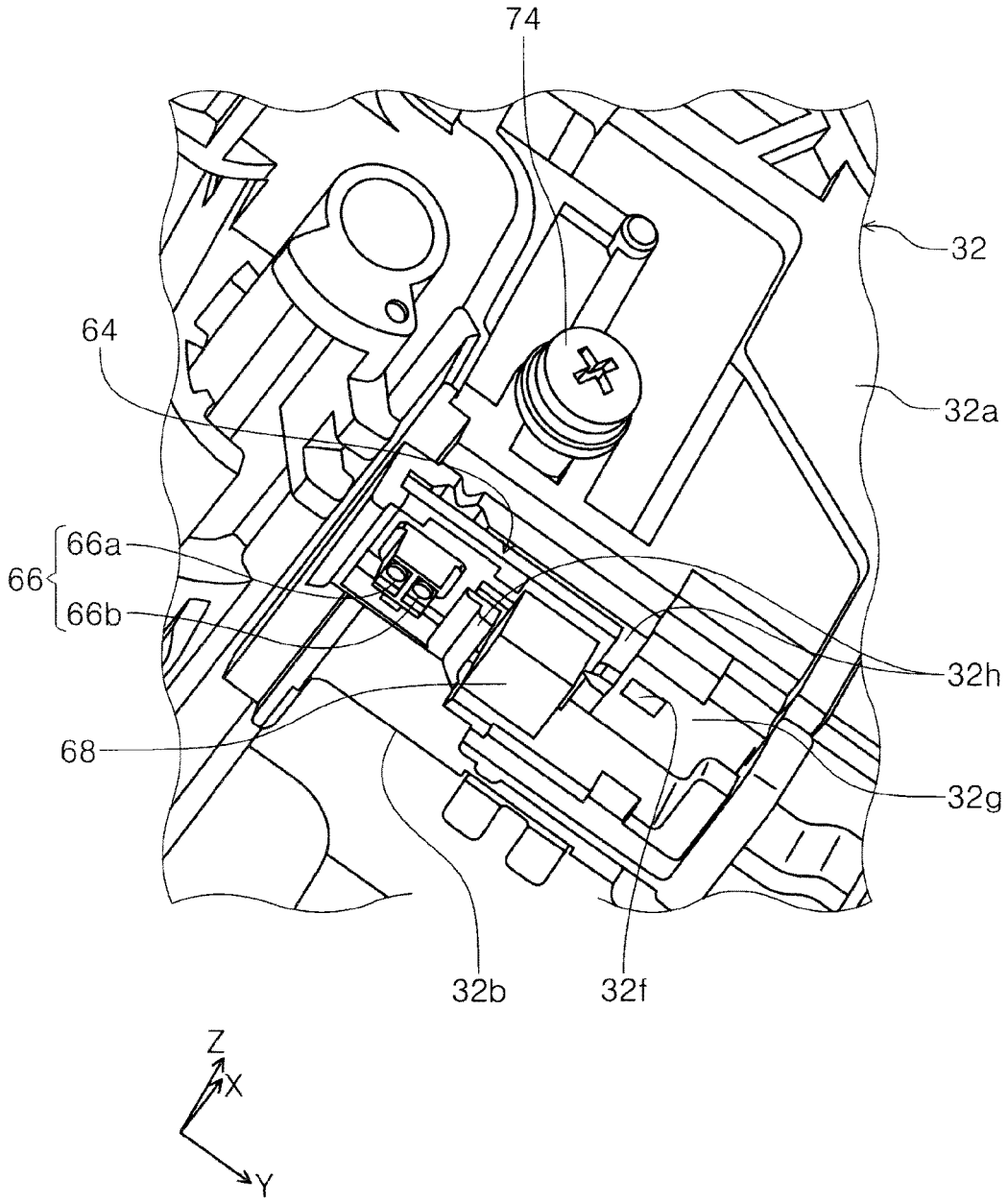
FIG. 10 is a perspective view of a detection unit mounted on an installation part of the printer.
Figure 11:
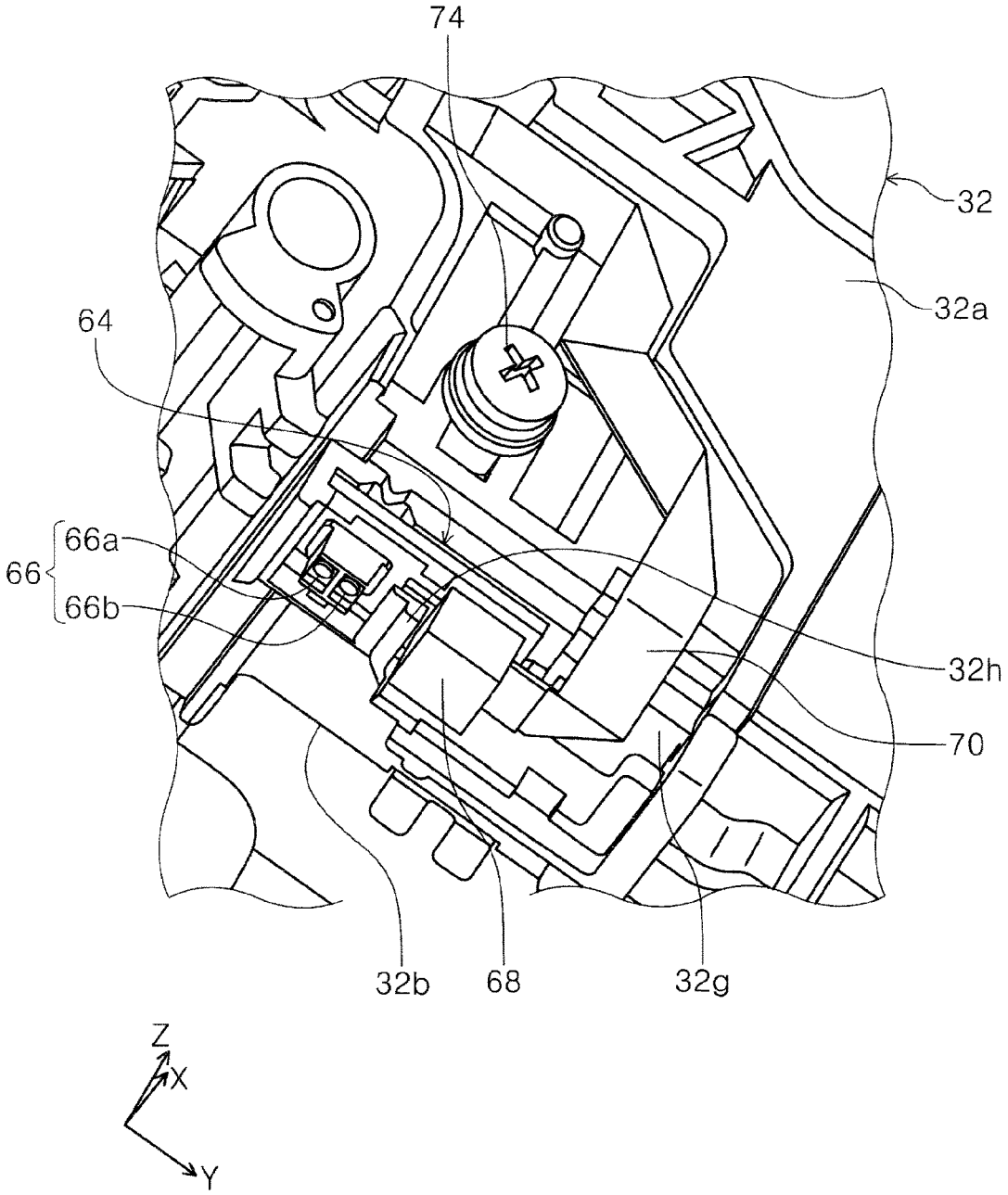
FIG. 11 is a perspective view of the detection unit to which a cable is connected.
Figure 12:
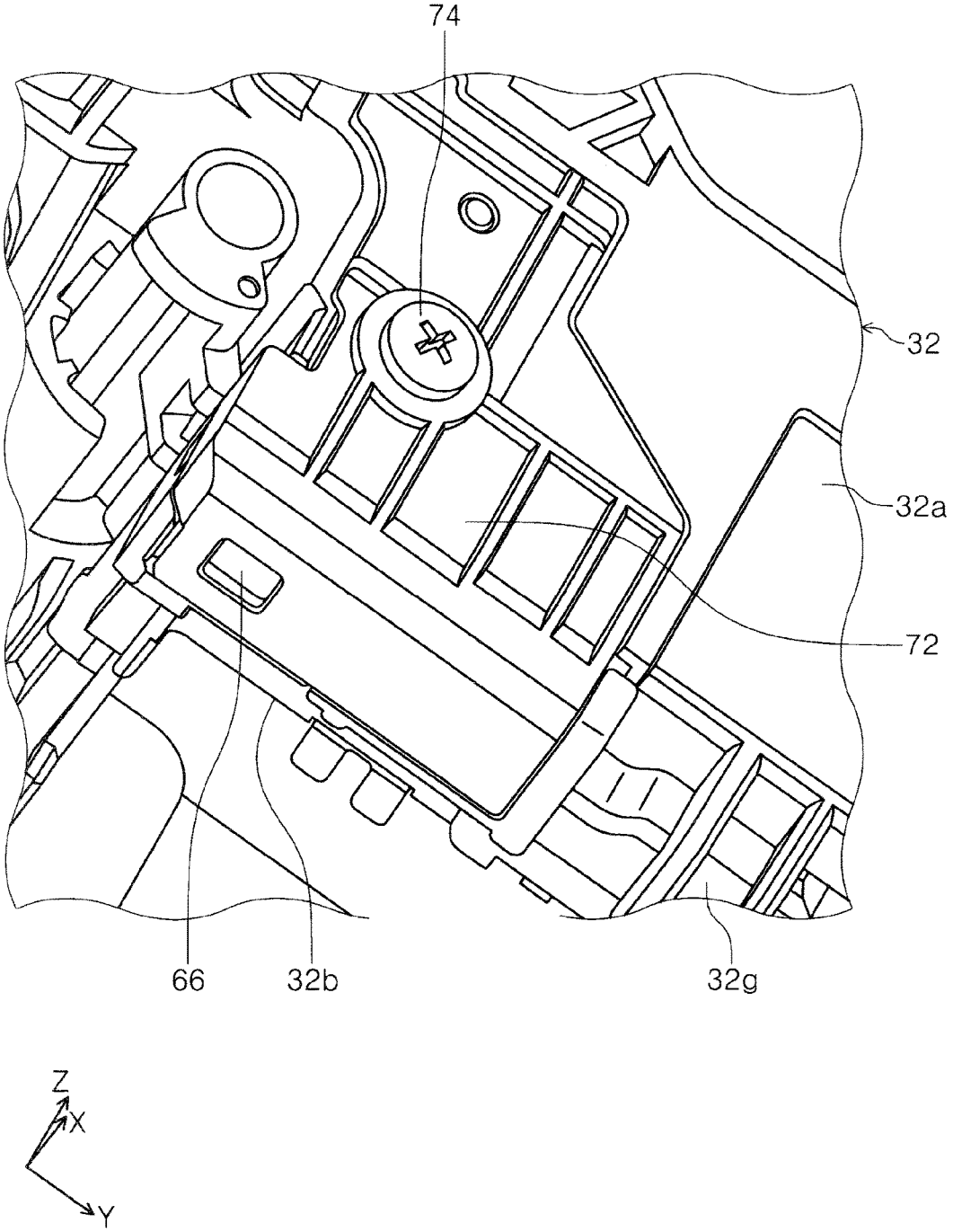
FIG. 12 is a perspective view of the detection unit to which a cover is attached.
Figure 13:
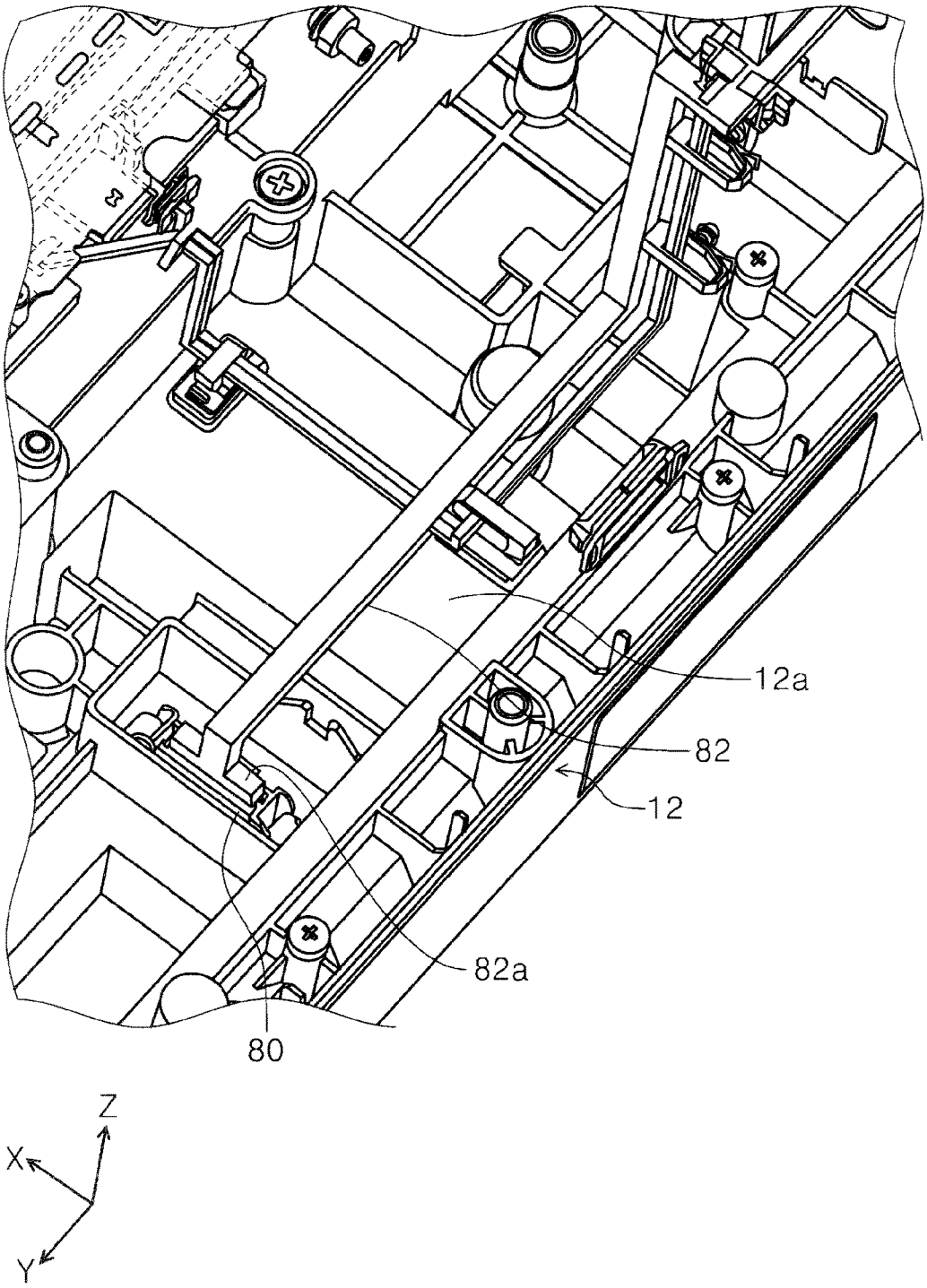
FIG. 13 is a perspective view of a wire extending from a connector connected to a connecting part in the apparatus main body.

FIG. 10 is a perspective view of a detection unit mounted on an installation part of the printer. FIG. 11 is a perspective view of the detection unit to which a cable is connected. FIG. 12 is a perspective view of the detection unit to which a cover is attached. FIG. 13 is a perspective view of a wire extending from a connector connected to a connecting part in the apparatus main body.

Figure 14:
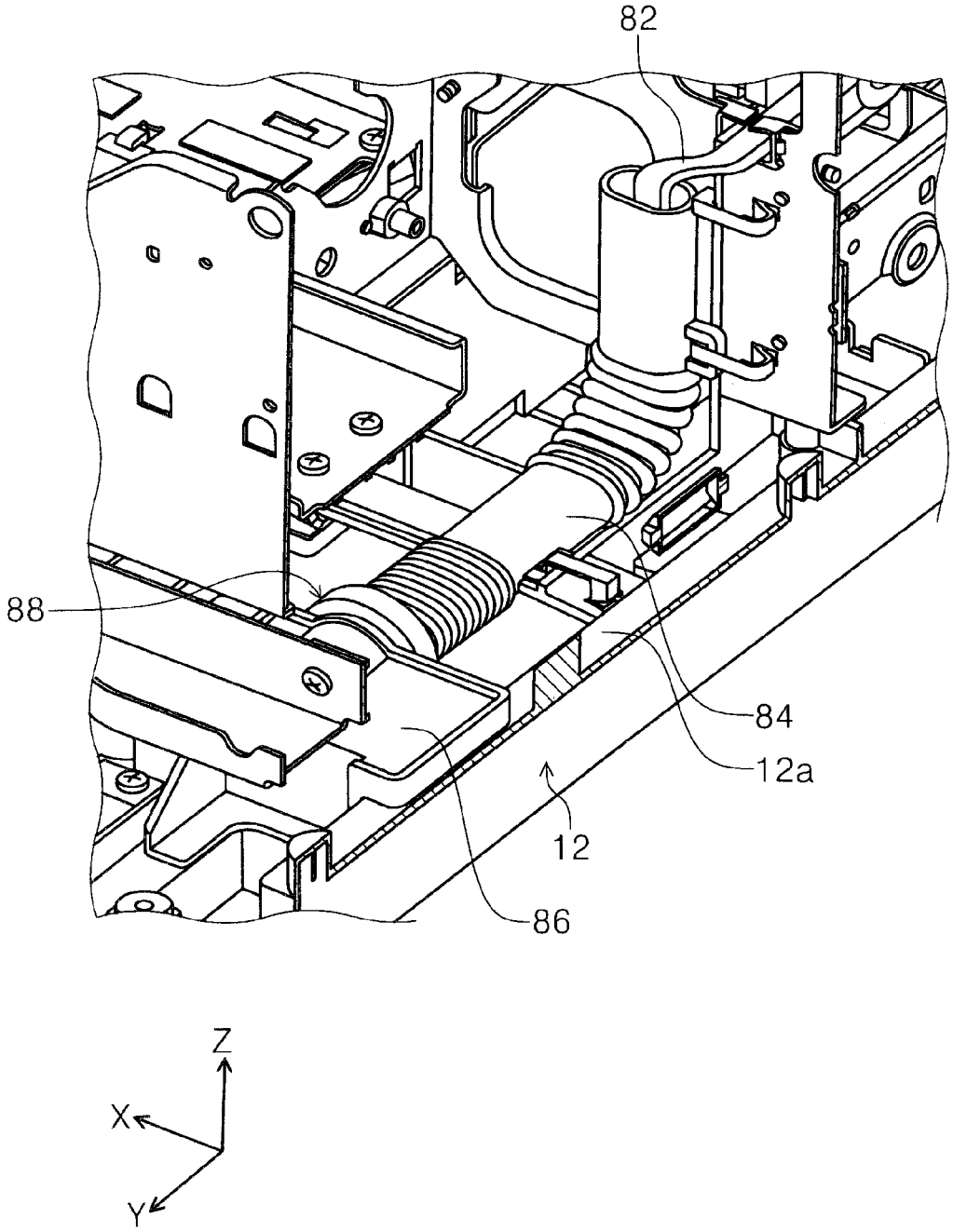
FIG. 14 is a perspective view of the wire covered with a cover member and a drip-proof member.
Figure 15:
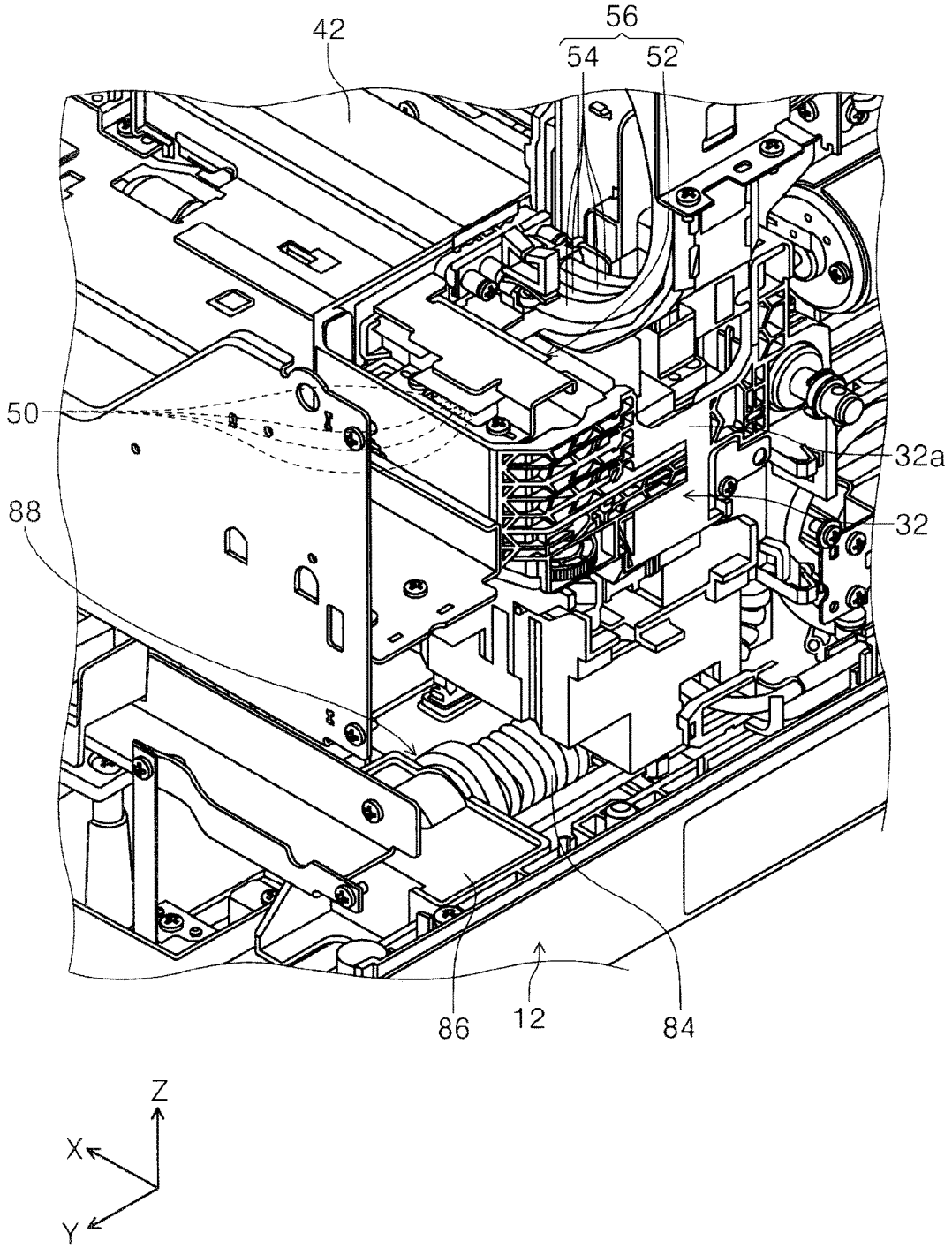
FIG. 15 is a perspective view of the positional relationship of the cover member, the drip-proof member, and the carriage.
Figure 16:
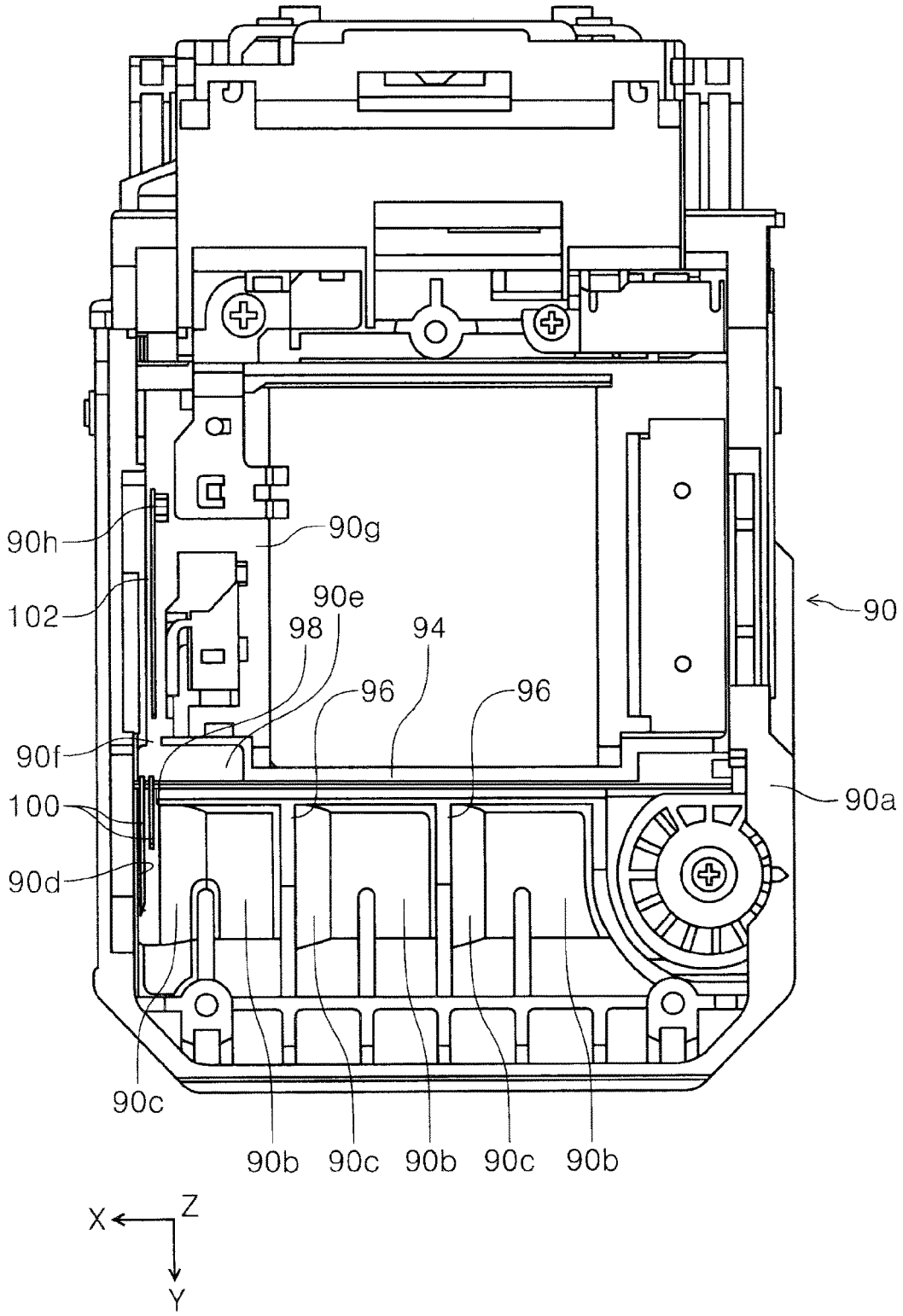
FIG. 16 is a plan view of a housing of a carriage in a printer according to a second embodiment of the disclosure.
Figure 17:
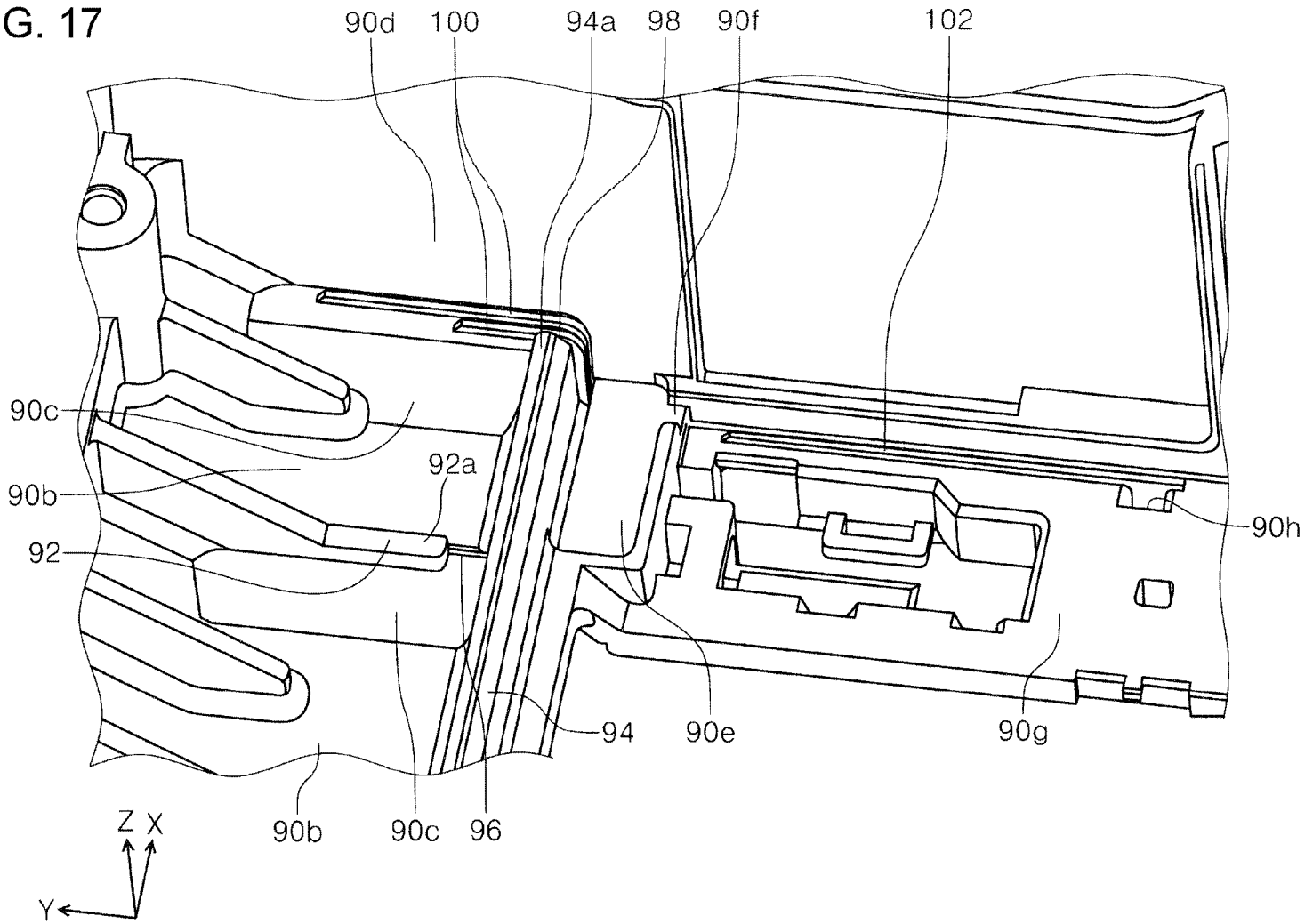
FIG. 17 is a perspective view of an ink guiding mechanism in the printer according to a second embodiment of the disclosure.

FIG. 14 is a perspective view of the wire covered with a cover member and a drip-proof member. FIG. 15 is a perspective view of the positional relationship of the cover member, the drip-proof member, and the carriage. FIG. 16 is a plan view of a housing of a carriage in a printer according to a second embodiment of the disclosure. FIG. 17 is a perspective view of an ink guiding mechanism in the printer.

In the XYZ coordinate system of FIGS. 1 to 17, the X axis extends along the width of recording media, namely, the width of a recording apparatus; the Y axis extends along the depth of the recording apparatus; and the Z axis extends the height of the recording apparatus. Further, a +X direction is the leftward direction on the page of FIG. 1, whereas a −X direction is the rightward direction. A +Y direction is the forward direction on the page of FIG. 1, whereas a −Y direction is the backward direction, the recording media being transported along the transport path of the recording apparatus in the +Y direction. A +Z direction is the upward direction on the page of FIG. 1, whereas a −Z direction is the downward direction. Likewise, a +X side is the left side on the page of FIG. 1, whereas a −X side is the right side. A +Y side is the front side on the page of FIG. 1, whereas a −Y side is the back side. A +Z side is the upper side on the page of FIG. 1, whereas a −Z side is the lower side. A +X end is the left end on the page of FIG. 1, whereas a −X end is the right end. A +Y end is the front end on the page of FIG. 1, whereas a −Y end is the back end. A +Z end is the upper end on the page of FIG. 1, whereas a −Z end is the lower end.

First Embodiment

Outline of Printer

Referring to FIG. 1, a printer 10 includes an apparatus main body 12 and a scanner unit 14. For example, the printer 10 may be a multifunction printer (MFP), and the apparatus main body 12 may be a recording apparatus main body. The scanner unit 14 is disposed on the upper side, namely, the +Z side of the apparatus main body 12. The scanner unit 14 has an original cover (ADF) 14*a* that is rotatable around an axis on the back side, namely, the −Y side of the printer 10 and relative to the scanner unit 14. The ADF 14*a* of the scanner unit 14 can selectively have closed and open positions. In the closed position, the ADF 14*a* covers the top of the scanner unit 14 as depicted by the solid line in FIG. 1. In the closed position, the ADF 14*a* exposes the top of the scanner unit 14 as depicted by the alternate long and two short dashes line 14*a*-1 in FIG. 1.

Provided on the front side, namely, the +Y side of the apparatus main body 12 is an operating section 16 and an exhaust port 18. Provided under the exhaust port 18 is a medium tray 20, and provided under the medium tray 20 is a medium cassette 22. The medium cassette 22 is detachably inserted into the apparatus main body 12 from its front side.

In the first embodiment, provided under the apparatus main body 12 is an extension unit 24. The extension unit 24 has a medium cassette 26 that is detachably inserted into the extension unit 24 from its front side.

Referring to FIG. 2, the apparatus main body 12 includes a housing 28, an ink supply section 30, a carriage 32, a controller 34, and a power source 36. The housing 28 forms at least a portion of the bottom of the apparatus main body 12. The medium cassette 22 is detachably inserted into the housing 28. Both the ink supply section 30 and the carriage 32 are disposed over the housing 28 and in a front portion of the printer 10. More specifically, the ink supply section 30 is disposed within the apparatus main body 12 and near the +X side of the apparatus main body 12. Provided in the ink supply section 30 are a plurality of ink cartridges 38. These ink cartridges 38 are detachably inserted into the ink supply section 30 from the front side. For example, the ink cartridges 38 may contain black, magenta, cyan, yellow, and other colored inks.

The carriage 32 is disposed on the right of the ink supply section 30, namely, on the −X side of the apparatus main body 12. The carriage 32 is movable in the ±X directions. Provided under the carriage 32 is a recording head 40 as depicted by the broken line in FIG. 1 or as illustrated in FIG. 5. The recording head 40 has a plurality of nozzles through which inks supplied from the ink supply section 30 are to be ejected.

In the apparatus main body 12, the controller 34 and the power source 36 are disposed behind the ink supply section 30 and the carriage 32, namely, near the −Y direction sides of the ink supply section 30 and the carriage 32. In the first embodiment, the controller 34 is disposed in the right portion of the apparatus main body 12, whereas the power source 36 is disposed in the left portion of the apparatus main body 12. Although not illustrated, the power source 36 and the controller 34 are connected together by a cable, and the power source 36 thereby supplies electricity to the controller 34. In this embodiment, the controller 34 may be implemented using a circuit board on which a plurality of electronic components are mounted.

Carriage

A configuration of the carriage 32 will be described below with reference to FIGS. 3 to 12. In the first embodiment, the carriage 32 is provided with a housing 32*a* that has a box shape. This housing 32*a* is open on the top. A guide shaft 42 is inserted into a back portion of the housing 32*a*. This guide shaft 42 is provided in the apparatus main body 12 and extends along the X axis. In the first embodiment, the carriage 32 is movable along the guide shaft 42 in the ±X directions.

Disposed in the back portion of the housing 32*a* is a linear encoder 44 as illustrated in FIG. 9. In addition, a linear scale meter 46 that extends along the X axis is inserted into the linear encoder 44 as illustrated in FIG. 4. When the carriage 32 moves in the +X or −X direction, the linear encoder 44 also moves together with the carriage 32. As a result, the linear encoder 44 is displaced relative to the linear scale meter 46, so that it is possible to detect the location of the carriage 32 within its movable area.

Mounted inside the housing 32*a* of the carriage 32 is a recording head attachment member 48. The recording head 40 is mounted on the lower side of the recording head attachment member 48. When the recording head attachment member 48 is mounted inside the housing 32*a*, the recording head 40 protrudes in the −Z direction from the housing 32*a* of the carriage 32 through an aperture 32*b* formed in the bottom of the housing 32*a* as illustrated in FIGS. 5 and 6. In this instance, the recording head attachment member 48 and the recording head 40 may be integrated together.

Referring to FIG. 4, provided in an upper portion of the recording head attachment member 48 are a plurality of passage junctions 50. The recording head attachment member 48 has unillustrated ink passages inside. These ink passages are formed so as to extend from the passage junctions 50 to the recording head 40. The passage junctions 50 are connectable to an ink passage connecting member 52 as illustrated in FIG. 3. The ink passage connecting member 52 is connected to a plurality of ink tubes 54. These ink tubes 54 extend in the −X direction from the ink passage connecting member 52, then is curved in the +Z direction, and extend in the +X direction to reach the ink supply section 30. The ink passage connecting member 52 and the ink tubes 54 constitute an ink passage 56 extending from the passage junctions 50 to the ink supply section 30. In the first embodiment, the connection between the passage junctions 50 and the ink passage connecting member 52 enables the ink supply section 30 to supply ink to the recording head 40.

Ink Guiding Mechanism

Referring to FIGS. 6 and 7, the housing 32*a* of the carriage 32 is provided with a plurality of recesses 32*d* on an inner bottom 32*c* and near the +Y side of the housing 32*a*. The recesses 32*d* are arranged along the X axis and separated from one another by ribs 58. These ribs 58 is erected in the +Z direction from the bottom of the recesses 32*d* and extends along the Y axis. In addition, a rib 60 is provided on the −Y sides of the recesses 32*d*. This rib 60 is erected from the bottom of the recesses 32*d* in the +Z direction and extends along the X axis.

As illustrated in FIGS. 6 and 7, one of the recesses 32*d* which is positioned on the furthest +X side is provided with a plurality of ink guiding paths 62 on its +X side. The ink guiding paths 62 extend in the −Y direction from this recess 32*d*. In the first embodiment, as an example, the ink guiding paths 62 may be ribs that extend along the Y axis. As illustrated in FIG. 7, each ink guiding path 62 has a +Y axial end 62*a* within the recess 32*d* positioned on the furthest +X side. The ink guiding paths 62 extend in the −Y direction from the +Y axial ends 62*a*, go beyond the rib 60, and further extend in the −Z direction.

In the housing 32*a* of the carriage 32, a flat area 32*e* is formed on the −Y side of the recesses 32*d* positioned on the furthest +X side. The ink guiding paths 62 go beyond the rib 60, then go across the flat area 32*e* in the −Y direction, and extends in the −Z direction again. Then, the ink guiding paths 62 extend on the inner bottom 32*c* in the −Y direction and reach an ink exhaust port 32*f* provided in the inner bottom 32*c*. Each ink guiding path 62 has a −Y end 62*b* at a location related to the ink exhaust port 32*f*.

Referring to FIGS. 3, 8, and 9, if the ink passage connecting member 52 is connected to the passage junctions 50 imperfectly or if the ink passage connecting member 52 is disconnected from the passage junctions 50, the ink passage connecting member 52 or the passage junctions 50 may leak ink. In this instance, the leaking ink may flow into a plurality of recesses 48*a* provided in the recording head attachment member 48 which are positioned near the ±X sides of the passage junctions 50. Then, the leaking ink may spread out in ±X directions, and some of the leaking ink may flow into a plurality of through-holes 48*b* provided in the recesses 48*a* and flow in the −Y direction through the through-holes 48*b*. This ink may be transferred along sides of the recording head attachment member 48 and further flow in the −Y direction. In FIG. 8, examples of the routes along which the leaking ink flow from the recesses 48*a* are indicated by the alternate long and short dash lines.

As can be seen from FIGS. 8 and 9, the recesses 32*d* are positioned under the routes of the leaking ink. The recesses 32*d* are positioned within a region containing a lower portion of the passage junctions 50. In the first embodiment, the region containing the lower portion of the passage junctions 50 corresponds to a region containing a site at which the leaking ink may flow down. In this embodiment, as an example, the region may be a region S defined by the alternate long and short dash line in FIG. 6.

When the ink leaking from the passage junctions 50 flows into the recess 32*d* positioned on the furthest +X side, the ink may further flow to the ink guiding paths 62. Then, the ink may flow from the recess 32*d* to the ink exhaust port 32*f* along the ink guiding paths 62 due to the capillary phenomenon. After having entered the ink exhaust port 32*f* along the ink guiding paths 62, the ink may flow out from the inside to the outside of the housing 32*a* through the ink exhaust port 32*f*.

A configuration of a detection unit 64 will be described below with reference to FIGS. 5 and 10 to 12. Referring to FIG. 10, the housing 32*a* of the carriage 32 has an outer bottom 32*g* provided with installation parts 32*h* for the detection unit 64. In the first embodiment, as an example, the detection unit 64 may be an optical sensor. The detection unit 64 includes a reflective sensor 66 and a connector 68; the reflective sensor 66 has a light emitter 66*a* and a light receiver 66*b*.

The detection unit 64 is detachably attached to the installation parts 32*h* on the outer bottom 32*g* of the housing 32*a* from the −X side of the housing 32*a*. In the first embodiment, as an example, the sensor 66 may set a detection target to a medium such as recording paper. More specifically, the sensor 66 may detect an edge of the medium. In this embodiment, the detection unit 64 is detachable from the housing 32*a* in the −X direction. Thus, this configuration helps maintain the detection unit 64 and replace the detection unit 64 with another.

Referring to FIG. 10, the ink exhaust port 32*f* is provided at a location related to the installation parts 32*h* of the detection unit 64. Herein, the expression "at a location related to the installation parts 32*h*" refers to "near the installation parts 32*h*". Referring to FIG. 11, the connector 68 of the detection unit 64 is connected to an end of a cable 70. When the detection unit 64 outputs a detection signal, this detection signal is transmitted to the controller 34 through the cable 70. On the basis of the detection signal from the detection unit 64, the controller 34 controls an operation of at least one of the recording head 40 and the carriage 32. In this embodiment, as an example, the cable 70 may be a flexible flat cable (FFC). In the embodiment, at least a portion of the cable 70 may extend below the −Z side of the inner bottom 32*c* across the ink exhaust port 32*f*.

Referring to FIG. 12, a cover 72 is attached to the outer bottom 32*g* of the housing 32*a* by a fastener 74 so as to cover the detection unit 64 mounted on the installation parts 32*h*. In the first embodiment, the cover 72 is positioned between the sensor 66 and the detection target, or the medium. In this embodiment, as an example, the fastener 74 may be a screw member.

When the ink is guided to the ink exhaust port 32*f* (see FIG. 10) along the ink guiding path 62 (see FIG. 7), the ink may flow in the −Z direction through the ink exhaust port 32*f*. Then, the ink may adhere to the cable 70 positioned below the ink exhaust port 32*f*. When adhering to the cable 70, the ink may be transferred along the cable 70 due to the capillary phenomenon and then may reach the connector 68 (see FIG. 11). When reaching the connector 68, the ink may be further transferred to the periphery and sides of the detection unit 64 due to the capillary phenomenon and then may adhere to the light emitter 66*a* and/or the light receiver 66*b* in the sensor 66. As a result, the ink adhering to the sensor 66 may break into the optical path of the sensor 66.

As an example, if adhering to the light emitter 66*a*, the ink may attenuate or block the light that the light emitter 66*a* has emitted toward the detection target, or the medium. As another example, if adhering to the light receiver 66*b*, the ink may attenuate or block the light that the light emitter 66*a* has emitted and the detection target, or the medium has reflected. In either case, the light receiver 66*b* may fail to detect the reflected light appropriately. As a result, the detection signal output from the sensor 66 differs from usual. On the basis of this detection signal, the controller 34 determines that the passage junctions 50 leak the ink. This configuration makes it possible to use existing components to sense leakage of ink from the passage junction 50 without having to provide any dedicated sensor. In short, the first embodiment provides a low-cost printer 10 that can sense leakage of ink.

In the first embodiment, the recesses 32*d*, the ink guiding paths 62, the ink exhaust port 32*f*, the cable 70, and the connector 68 constitute an ink guiding mechanism 76 that guides ink from the passage junctions 50 to the sensor 66.

Wire Between Apparatus Main Body and Extension Unit

A wire between the apparatus main body 12 and the extension unit 24 will be described with reference to FIGS. 2 and 13 to 15. Referring to FIG. 2, mounted in the extension unit 24 is an extension unit circuit board 78. Referring to FIG. 13, the apparatus main body 12 has a bottom 12*a* on which a connecting part (connector) 80 is mounted. The connecting part 80 is connected to a connector 82*a* provided at a first end of the wire 82. A second end of the wire 82 is connected to the controller 34. Furthermore, the connecting part 80 is also connected to an unillustrated wire extending from the extension unit circuit board 78. The extension unit circuit board 78 is thereby electrically connected to the controller 34.

Referring to FIG. 13, the wire 82 extends in the −Y direction from the connecting part 80 and then is curved upward and further extends in the +Z direction. In the first embodiment, the wire 82 is covered with and supported by a drip-proof member 84 with a tubular shape, as illustrated in FIG. 14. Mounted on the bottom 12*a* of the apparatus main body 12 is a cover member 86 that is disposed above the connecting part 80 so as to cover both the connecting part 80 and the connector 82*a*. The drip-proof member 84 is coupled to the cover member 86 through a joint part 88. In this embodiment, the wire 82 connected to the connecting part 80 passes through the interiors of the cover member 86 and the drip-proof member 84 and is connected to the controller 34.

In the first embodiment, at least a part of the wire 82 covered with the drip-proof member 84 is positioned within the region in which the carriage 32 is permitted to move, more specifically below a home position of the carriage 32, as illustrated in FIG. 15. In this embodiment, even if the carriage 32 leaks ink through the ink exhaust port 32*f*, the drip-proof member 84 that covers the wire 82 suppresses the ink from adhering to the wire 82. Moreover, the cover member 86 that covers both the connecting part 80 and the connector 82*a* also suppresses the ink leaking through the ink exhaust port 32*f* from adhering to the wire 82.

Modification of First Embodiment (1) In the first embodiment, the ink is guided to the detection unit 64 by way of the cable 70; however, as an alternative example, the ink may be guided to the detection unit 64 by way of the cover 72. In this example, ink may be guided by the installation part 32*h* and flow through the ink exhaust port 32*f*. Then, the cover 72 provided below the ink exhaust port 32*f* may receive this ink and guide the ink to a location where the sensor 66 and the detection target are aligned with each other. After the ink is guided to the gap between the detection unit 64 and the cover 72, the ink may stay at the location where the sensor 66 and the detection target, or the medium, are aligned with each other, in other words, on the optical path of the sensor 66. In this configuration, the cover 72 suppresses the detection unit 64 and the cable 70 from being contaminated by the ink. By replacing the cover 72 with a new one, therefore, the detection unit 64 and the cable 70 can be returned to be in a normal clean condition. Thus, this configuration can be maintained easier than a configuration in which the detection target or both the detection unit 64 and the cable 70 may be contaminated by ink. Furthermore, a screw member is used as the fastener 74 in this embodiment; however, for example, a bolt may be used instead. Moreover, in the embodiment, the cover 72 serves as a portion of the ink guiding mechanism 76 and guides ink from the passage junctions 50 to the sensor 66; however, as an alternative example, ink may adhere to the cover 72 and break into the optical path of the sensor 66.

(2) In the first embodiment, a rib is used as the ink guiding path 62; however, a groove may be used instead. Furthermore, the housing 32*a* of the carriage 32 may include, as the ink guiding path, a corner section that has surfaces intersecting each other. As illustrated in FIG. 7, as an example, the ink guiding path may be a corner section 32*k* in which a side surface 32*j* of the housing 32*a* intersects the bottom of the recess 32*d* positioned on the furthest +X side.

(3) In the first embodiment, the ink guiding paths 62 are provided on the inner bottom 32*c* of the housing 32*a* of the carriage 32 to guide ink from the recess 32*d* positioned on the furthest +X side to the ink exhaust port 32*f* of the housing 32*a*. Instead of this configuration, as an alternative example, the ink exhaust port 32*f* may be provided in the recess 32*d* positioned on the furthest +X side, and the ink guiding paths 62 may be provided from a site related to the ink exhaust port 32*f* to the detection unit 64 on the outer bottom 32*g* of the housing 32*a*.

(4) In the first embodiment, the ink exhaust port 32*f* may be provided at a site related to the recesses 32*d* that can contain a preset amount of ink. If ink overflows from the recesses 32*d*, the ink may be discharged to the outside through the ink exhaust port 32*f*. In addition, vibrations of the carriage 32 moving during a recording operation may drip ink onto the recording surface of the detection target, or the medium. This configuration can inform a user of ink leakage even if the detection unit 64 does not detect the overflowing ink, because the ink adheres to the recording surface of the medium and thus contaminants the recording surface.

(5) In the first embodiment, the detection unit 64 provided in the carriage 32 serves as a medium sensor that detects an edge of the detection target, or the medium, in the apparatus main body 12. Instead of this configuration, prisms that measure remaining amounts of inks in the ink cartridges detachably attached to the housing 32*a* of the carriage 32 are provided as detection targets. In addition, ink amount sensors may be provided in the apparatus main body 12 as detection units and detect the remaining amounts of ink by irradiating the prisms with light. Instead of the prisms, reflectors or reference white boards may be used. Alternatively, a linear encoder may be provided, as a detection unit, on the bottom of the carriage 32 and read a linear scale meter that serves as a detection target. Moreover, the detection unit 64 may be implemented using a mechanical switch. For example, this mechanical switch may detect ink leakage in response to an occurrence of a short circuit of its switch contact which may be attributed to ink leakage.

Second Embodiment

Next, a description will be given of an ink guiding mechanism in a printer according to a second embodiment of the disclosure, with reference to FIGS. 16 and 17. Referring to FIG. 16, a plurality of recesses 90*b* are disposed on the +Y side of a housing 90*a* of a carriage 90 and arranged along the X axis. In the second embodiment, each recess 90*b* has a sloping surface 90*c* (see FIG. 17) on its +X side, and each sloping surface 90*c* is erected in the +Z direction. In this embodiment, the recesses 90*b* are separated from one another by ribs 92, each of which extends along the Y axis and has a −Y end 92*a* at a site related to the −Y side of the recesses 90*b*. More specifically, formed between the −Y end 92*a* of each rib 92 and a rib 94 to be described later which extends along the X axis is a gap 96 (see FIG. 17). In this embodiment, adjacent recesses 90*b* communicate with each other near the −Y ends 92*a* along the Y axis and through the sloping surfaces 90*c* and the gaps 96.

In the second embodiment, the rib 94 extends along the X axis near the −Y ends 92*a* of the recesses 90*b*. In this embodiment, the rib 94 has a +X side 94*a* that is positioned near a +X side 90*d* of the housing 90*a* with a gap 98 therebetween.

The recess 90*b* positioned on the furthest +X side in FIGS. 16 and 17 has a plurality of ink guiding paths 100 that extend along the Y axis and is formed on the +X side of the sloping surface 90*c*. In the second embodiment, as an example, each ink guiding path 100 may be a rib that extends along the Y axis. As illustrated in FIG. 17, each ink guiding path 100 extends in the −Y direction, then goes across the gap 98 in which the rib 94 is not provided, and further extends in the −Z direction.

Provided below and adjacent to the gap 98 in the −Y direction is a recess 90*e*, which is positioned at the site corresponding to the flat area 32*e* in the first embodiment. This recess 90*e* has a notch 90*f*.

Provided on the inner bottom 90*g* that is positioned lower than the recess 90*e* is an ink guiding path 102, which has the form of a rib and extends along the Y axis. This ink guiding path 102 has a −Y end, and an ink exhaust port 90*h* is provided at a site corresponding to the −Y end.

In the second embodiment, if the passage junctions 50 leak ink, the ink may flow into the recesses 90*b*, and then when the ink overflows from the recesses 90*b*, the ink may flow into the recess 90*e* along the ink guiding paths 100. Then, the ink may be guided from the recess 90*e* to an ink exhaust port 90*h* along the ink guiding path 102, after which the ink may flow out from the inside to the outside of the housing 90*a* of the carriage 90 by way of the ink exhaust port 90*h*.

Modification of Second Embodiment (1) In the second embodiment, a rib is used for each of the ink guiding paths 100 and 102; however, a groove may be used instead. Alternatively, a corner section that has surfaces intersecting each other may be used.

(2) In the second embodiment, the ink exhaust port 90*h* is provided at the end of the ink guiding path 102; however, the ink exhaust port 90*h* may be provided at a site related to the recesses 90*b*. In this case, after having flown out from the inside to the outside of the housing 90*a* through the ink exhaust port 90*h*, the ink may be guided to the detection unit 64 along the ink guiding paths 100 and 102 provided on the outer bottom of the carriage 90.

As described above, a printer 10 includes a recording head 40 from which ink is ejected. An ink supply section 30 supplies the ink to the recording head 40. A carriage 32 or 90 reciprocates in predetermined directions and is provided with the recording head 40 and includes a passage junction 50 to be connected to or disconnected from an ink passage 56 formed between the ink supply section 30 and the recording head 40. A detection unit 64 converts a result of detecting a detection target into an electrical signal and is used to control at least one of the recording head 40 and the carriage 32 or 90. One of the detection target and the detection unit 64 is mounted in the carriage 32 or 90. The carriage 32 or 90 has an ink guiding mechanism 76 that guides the ink from a region S to the detection target or an installation part 32*h* for the detection unit 64, the region S containing a lower portion of the passage junction 50, a plurality of recesses 32*d* are provided within the region S.

In the above configuration, the detection unit 64 is used to control at least one of the recording head 40 and the carriage 32 or 90. The detection target is to be detected by the detection unit 64. One of the detection unit 64 and the detection target is mounted in the carriage 32 or 90. The carriage 32 or 90 has an ink guiding mechanism 76 that guides the ink from a region S to the detection target or an installation part 32*h* for the detection unit 64, the region S containing a lower portion of the passage junction 50, a plurality of recesses 32*d* or 90*b* being provided in the region S. If the passage junction 50 leaks ink, this ink is guided to the installation part 32*h* by the ink guiding mechanism 76. In response, a detection state of the detection unit 64 changes so that the detection result is, in most cases, different from that obtained when the detection unit 64 detects the detection target. On the basis of this detection state, the printer 10 determines that the passage junction 50 leaks ink.

In the above way, the printer 10 can use existing components to detect leakage of ink from the passage junction 50 without having to provide any dedicated sensor. In short, it is possible to provide a low-cost printer 10 that can detect ink leakage.

The installation part 32*h* may be mounted on an outer bottom 32*g* of the carriage 32 or 90. The ink guiding mechanism 76 may include an ink exhaust port 32*f* or 90*h* that is provided in a bottom of the carriage 32. Through the ink exhaust port 32*f*, the ink flows out from an inside to an outside of the carriage 32. This configuration can guide the ink to the installation part 32*h* mounted on the outer bottom 32*g* of the carriage 32.

The ink guiding mechanism 76 may include an ink guiding path 62, 100 or 102 provided on an inner bottom 32*c* or 90*g* of the carriage 32 or 90. Along the ink guiding path 62, 100 or 102, the ink is guided from a region S to the ink exhaust port 32*f* or 90*h*, the region S containing a lower portion of the passage junction 50 mounted, a plurality of recesses 32*d* or 90*b* being provided within the region S. This configuration can reliably guide the ink to the installation part 32*h* by way of the ink exhaust port 32*f* or 90*h*.

The ink exhaust port 32*f* may be provided within the region S, the region S containing the lower portion of the passage junction 50, a plurality of recesses 32*d* being provided within the region S. The ink guiding mechanism 76 may include an ink guiding path 62, 100 or 102 provided on the outer bottom 32*g* of the carriage 32 or 90, the ink being guided from the ink exhaust port 32*f* or 90*h* to the installation part 32*h* along the ink guiding path 62, 100 or 102. This configuration can reliably guide the ink to the installation part 32*h* along the ink guiding path 62, 100 or 102.

The ink guiding path 62, 100 or 102 may be a rib. This configuration enables the ink guiding path 62 to be formed easily at low cost.

The ink guiding path 62, 100 or 102 may be a groove. This configuration enables the ink guiding path to be formed easily at low cost.

The ink guiding path 62, 100 or 102 may include a corner section 32*k* formed in the carriage 32 or 90, the corner section 32*k* having two surfaces, such as a bottom surface of the recess 32*d* and a side surface 32*j* of the housing 32*a*, that intersect each other. This configuration enables ink guiding path 62, 100 or 102 to be formed easily at low cost.

The outer bottom 32*g* of the carriage 32 may be provided with a cover 72 that covers the installation part 32*h*. The cover 72 may be positioned between the detection target and the detection unit 64. The cover 72 may guide the ink that has been guided to the installation part 32*h* to a location at which the detection target and the detection unit 64 are aligned with each other.

In the above configuration, the outer bottom 32*g* of the carriage 32 may be provided with a cover 72 that covers the installation part 32*h*. The cover 72 may be positioned between the detection target and the detection unit 64. The cover 72 may guide the ink that has been guided to the installation part 32*h* to a location at which the detection target and the detection unit 64 are aligned with each other. Therefore, this configuration suppresses the detection target or the detection unit 64 from being contaminated directly by ink. By replacing the cover 72 with a new one, thus, a contaminated condition of the printer 10 can be returned to be a normal clean condition. Consequently, this configuration can be maintained more easily than a configuration in which the detection target or the detection unit 64 may be contaminated by ink.

The detection unit 64 may be provided in the carriage 32, and may set the detection target to a medium and detect an edge of the medium. Alternatively, the detection unit 64 may be provided in the carriage 32, and may set the detection target to a linear scale meter 46 and read the linear scale meter 46.

In the first and second embodiments and their modifications, the ink guiding mechanism 76 is applied to an ink jet printer, which is an example of liquid ejection apparatuses. However, the ink guiding mechanism 76 may be applied to other types of liquid ejection apparatuses.

An example of such liquid ejection apparatuses is recording apparatuses, such as printers, copiers, and facsimiles, that have ink jet recording heads and record information on recording media by ejecting ink from the recording heads. Another example is apparatuses that eject liquid from liquid ejecting heads to ink receiving media, instead of ejecting ink, thereby causing the liquid to land on the ink receiving media. In this case, the liquid may be selected as appropriate in accordance with an application. In addition, the liquid ejecting heads correspond to the liquid ejecting heads of the recording apparatuses, and the ink receiving media correspond to the recording media for the recording apparatuses.

Non-limiting examples of such liquid ejecting heads include; in addition to recording heads, color material ejection heads used to fabricate color filters for liquid crystal displays or other similar displays; electrode material (conductive paste) ejection heads used to fabricate electrodes for organic electroluminescence (EL) displays, field emission displays (FEDs), and other similar displays; living organic material ejection heads used to fabricate biochips; and sample ejection heads serving as precise pipets.

Liquid ejection apparatuses may employ a serial system in which a liquid ejecting head is movable. Alternatively, liquid ejection apparatuses may employ a line system in which a stationary recording head ejects liquid onto a whole width of a recording medium.

The disclosure is not limited to the foregoing first and second embodiments and modifications and may be modified in various ways within the scope of the claims. Obviously, such modifications also fall within the scope of the disclosure.

What is claimed is:

1. A recording apparatus comprising:

a recording head from which ink is ejected;

an ink supply section that supplies the ink to the recording head;

a carriage that reciprocates in predetermined directions and that is provided with the recording head and includes a passage junction to be connected to or disconnected from an ink passage formed between the ink supply section and the recording head; and a detection unit that converts a result of detecting a detection target into an electrical signal, the detection unit being used to control at least one of the recording head and the carriage, one of the detection target and the detection unit being mounted in the carriage, the carriage having an ink guiding mechanism that guides the ink from a region positioned below the passage junction in a vertical direction to the detection target or an installation part for the detection unit.

2. The recording apparatus according to claim 1, wherein the installation part is mounted on an outer bottom of the carriage, and the ink guiding mechanism includes an ink exhaust port provided in a bottom of the carriage, the ink exhaust port allowing leaking ink to flow out from an inside to an outside of the carriage.

3. The recording apparatus according to claim 2, wherein the ink guiding mechanism includes an ink guiding path provided on an inner bottom of the carriage, and the ink is guided from a region positioned below the passage junction in the vertical direction to the ink exhaust port along the ink guiding path.

4. The recording apparatus according to claim 3, wherein the ink guiding path is a rib.

5. The recording apparatus according to claim 3, wherein the ink guiding path is a groove.

6. The recording apparatus according to claim 3, wherein the ink guiding path includes a corner section formed in the carriage, the corner section having two surfaces that intersect each other.

7. The recording apparatus according to claim 2, wherein the ink exhaust port is provided within a region positioned below the passage junction in the vertical direction, and the ink guiding mechanism includes an ink guiding path provided on the outer bottom of the carriage, the ink being guided from the ink exhaust port to the installation part along the ink guiding path.

8. The recording apparatus according to claim 2, wherein the outer bottom of the carriage is provided with a cover that covers the installation part, the cover is positioned between the detection target and the detection unit, and the cover guides the ink that has been guided to the installation part to a location at which the detection target and the detection unit are aligned with each other.

9. The recording apparatus according to claim 1, wherein the detection unit is provided in the carriage, and sets the detection target to a medium and detects an edge of the medium.

10. The recording apparatus according to claim 1, wherein the detection unit is provided in the carriage, and sets the detection target to a linear scale meter and reads the linear scale meter.

* * * * *